US008297212B2

(12) United States Patent
Tseng

(10) Patent No.: US 8,297,212 B2
(45) Date of Patent: Oct. 30, 2012

(54) TRAVEL BEGINNING/END ADJUSTING POSITIONING STRUCTURE FOR A SEWING MACHINE MOTOR DRIVE MECHANISM

(76) Inventor: Hsien-Chang Tseng, Taichung (TW)

( * ) Notice: Subject to any disclaimer, the term of this patent is extended or adjusted under 35 U.S.C. 154(b) by 120 days.

(21) Appl. No.: 13/034,593

(22) Filed: Feb. 24, 2011

(65) Prior Publication Data

US 2012/0216733 A1 Aug. 30, 2012

(51) Int. Cl.
*D05B 69/22* (2006.01)

(52) U.S. Cl. ..... 112/220

(58) Field of Classification Search .... 112/217.1–217.3, 112/220, 314–319
See application file for complete search history.

(56) References Cited

U.S. PATENT DOCUMENTS 2,205,176 A * 6/1940 Sauer ..... 474/115
2,758,558 A * 8/1956 Waterman ..... 112/279
4,191,120 A * 3/1980 Bergvall ..... 112/443
4,503,792 A * 3/1985 Cook ..... 112/220
4,512,752 A * 4/1985 Brenneman ..... 474/114
4,764,426 A * 8/1988 Nakamura et al. ..... 428/400
5,481,165 A * 1/1996 Urano et al. ..... 318/5
6,705,581 B2 * 3/2004 Trago et al. ..... 248/656

FOREIGN PATENT DOCUMENTS

TW 200934907 A * 8/2009 ..... 112/220

* cited by examiner

*Primary Examiner* — Danny Worrell

(57) ABSTRACT

A travel beginning/end adjusting positioning structure for a sewing machine motor drive mechanism comprises a fixed holder, a positioning holder and an adjusting apparatus. By adjusting the relative position of the center of the rotating element of the motor and the control shaft using the adjusting apparatus, the control element on one end of the control shaft will rotate synchronously, and a mechanism connected to the other end of the control shaft will also rotate to a beginning and an end points of a different travel. By such arrangements, when the control element is driven by the motor, the mechanism connected to the control shaft will operate according to different travels, thus achieving the objective of adjusting travel.

8 Claims, 11 Drawing Sheets

TRAVEL BEGINNING/END ADJUSTING POSITIONING STRUCTURE FOR A SEWING MACHINE MOTOR DRIVE MECHANISM

BACKGROUND OF THE INVENTION

1. Field of the Invention

The present invention relates to a sewing machine, and more particularly to a travel beginning/end adjusting positioning structure for a sewing machine motor drive mechanism.

2. Description of the Prior Art

A sewing machine has many reciprocating mechanisms such as needle, cloth delivering gear and shuttle that all move in a reciprocating manner or produce a travel that the reciprocating rotary motion is converted to the reciprocating linear motion. To avoid unwanted loosening after adjustment which can lead to uncertain operation, the conventional sewing machines rarely have an adjustable structure.

In view of this, the inventor of the present invention has developed a beginning/end adjusting positioning structure for a travel of a sewing machine motor drive mechanism.

SUMMARY OF THE INVENTION

The primary objective of the present invention is to provide a travel beginning/end adjusting positioning structure for a sewing machine motor drive mechanism, an adjusting apparatus is disposed between the positioning holder fixing the motor and the fixed holder fixed on the sewing machine. A control shaft is pivotally inserted through the positioning holder and the fixed holder, so that the positioning holder can rotate around the control shaft. The rotating element of the motor is engaged with the control element on one end of the control shaft, and the other end of the control shaft is provided with a swing arm. The rotating element of the motor rotates back and forth to drive the control element to swing back and forth, and thus the swing arm on the other end of the control shaft will produce a back and forth travel. When the adjusting apparatus performs the adjustment, the positioning holder can rotate around the control shaft, synchronously driving the control element and the control shaft to rotate an adjusting angle to achieve the adjustment objective.

The secondary objective of the present invention is provide a travel beginning/end adjusting positioning structure for a sewing machine motor drive mechanism, through cooperation of the locking element in the adjusting apparatus and the positioning portion of the positioning holder, the locking element can enhance the stability of the adjusting positioning structure of the present invention during the adjustment.

To achieve the above objectives, a travel beginning/end adjusting positioning structure for a sewing machine motor drive mechanism in accordance with the present invention is provided, the sewing machine includes a control shaft, on the control shaft is provided a control element, and the travel beginning/end adjusting positioning structure comprises a fixed holder, a positioning holder and an adjusting apparatus. The fixed holder includes a through hole and a fixing portion. The fixing portion includes an insertion hole. The fixed holder is fixed on the base of the sewing machine. The positioning holder is provided with a through hole in alignment with the through hole of the fixed holder, and a positioning portion opposite the fixing portion of the fixed holder. The positioning portion is formed with a through hole. The fixed holder has a side for mounting a motor, and a rotating shaft of the motor is inserted through the through hole of the fixed holder and the through hole of the fixed holder. A rotating element is mounted on the rotating shaft of the motor and engaged with the control element of the control shaft. The adjusting apparatus includes an adjusting element, and a locking element screwed to the adjusting element. The locking element is in the form of a column and formed with an arc peripheral surface and a threaded hole in the arc peripheral surface. The adjusting shaft of the adjusting element is inserted through the fixing portion of the fixed holder and the through hole of the positioning portion of the positioning folder, and the locking element is screwed with the adjusting element. The arc peripheral surface of the locking element is partially engaged in the through hole of the positioning portion. By such arrangements, adjusting the adjusting element of the adjusting apparatus can control the rotating element assembled on the rotating shaft of the motor of the positioning holder to rotate an angle around the control shaft, synchronously changing the position of the respective elements connected to the rotating element, so that the travel of the swing mechanism connected to the control shaft can be assuredly adjusted and positioned.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
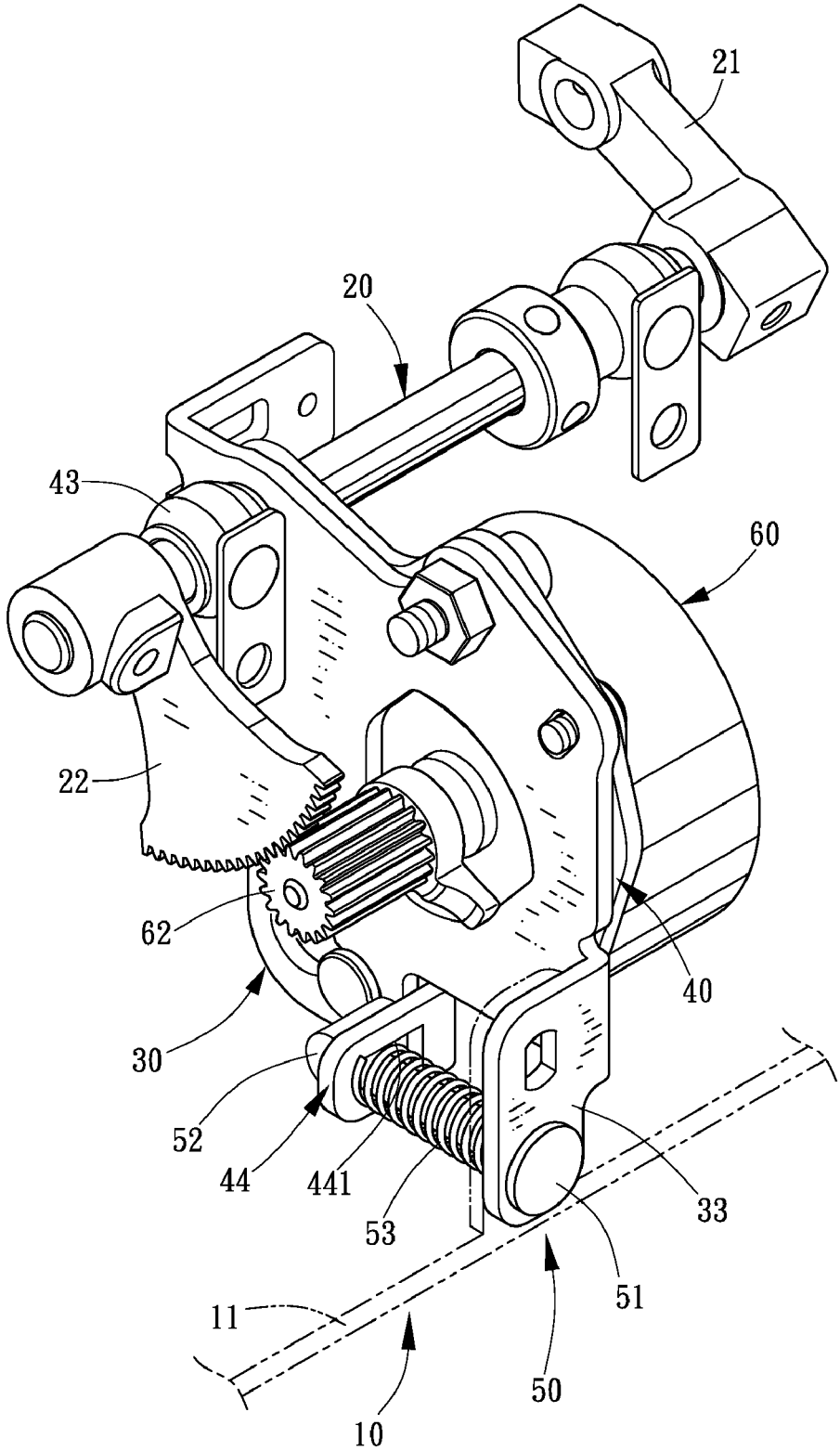
FIG. 1 is a perspective assembly view of a travel beginning/end adjusting positioning structure for a sewing machine motor drive mechanism in accordance the present invention.
Figure 2:
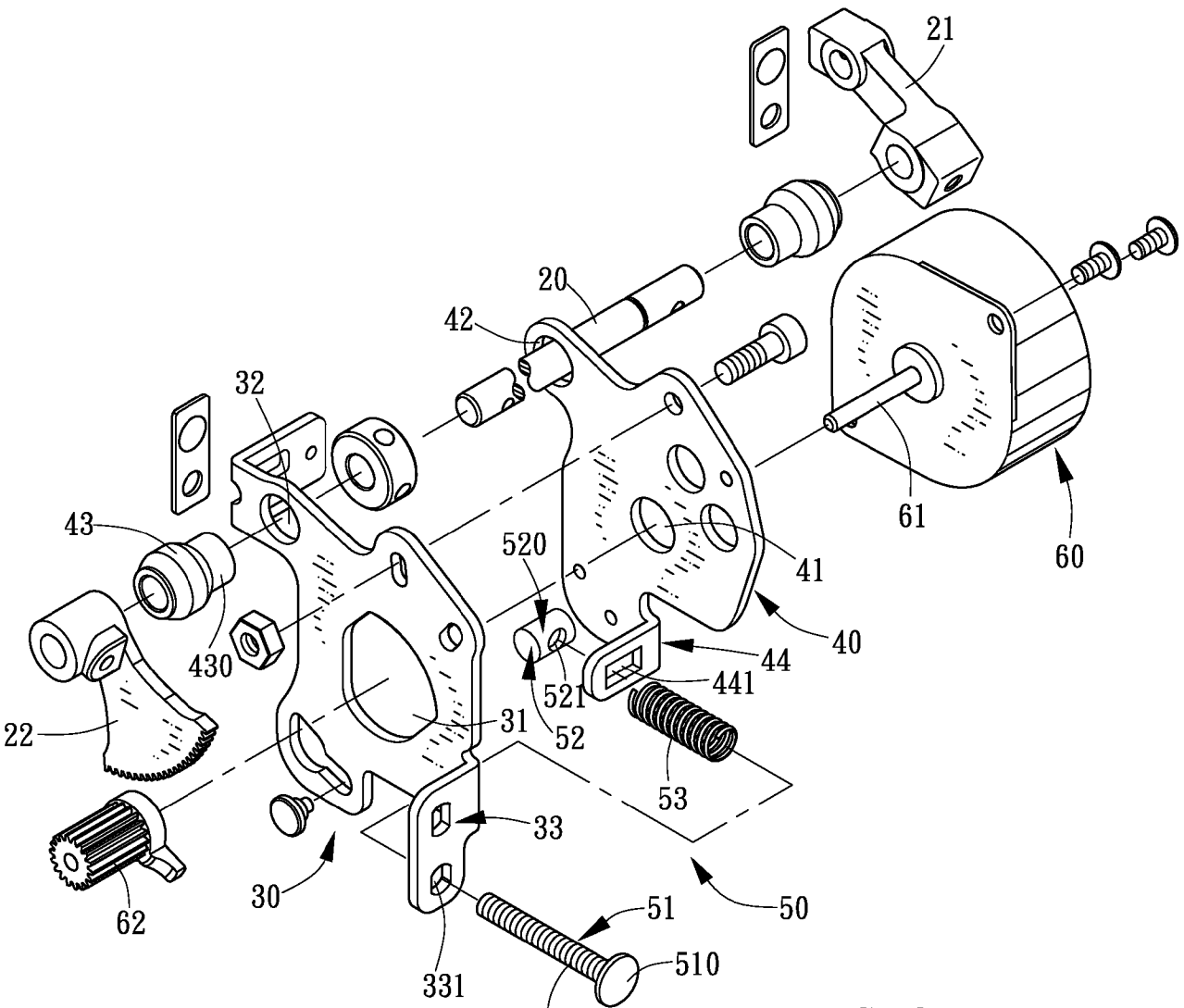
FIG. 2 is a perspective exploded view of the travel beginning/end adjusting positioning structure for a sewing machine motor drive mechanism in accordance the present invention.
Figure 3:
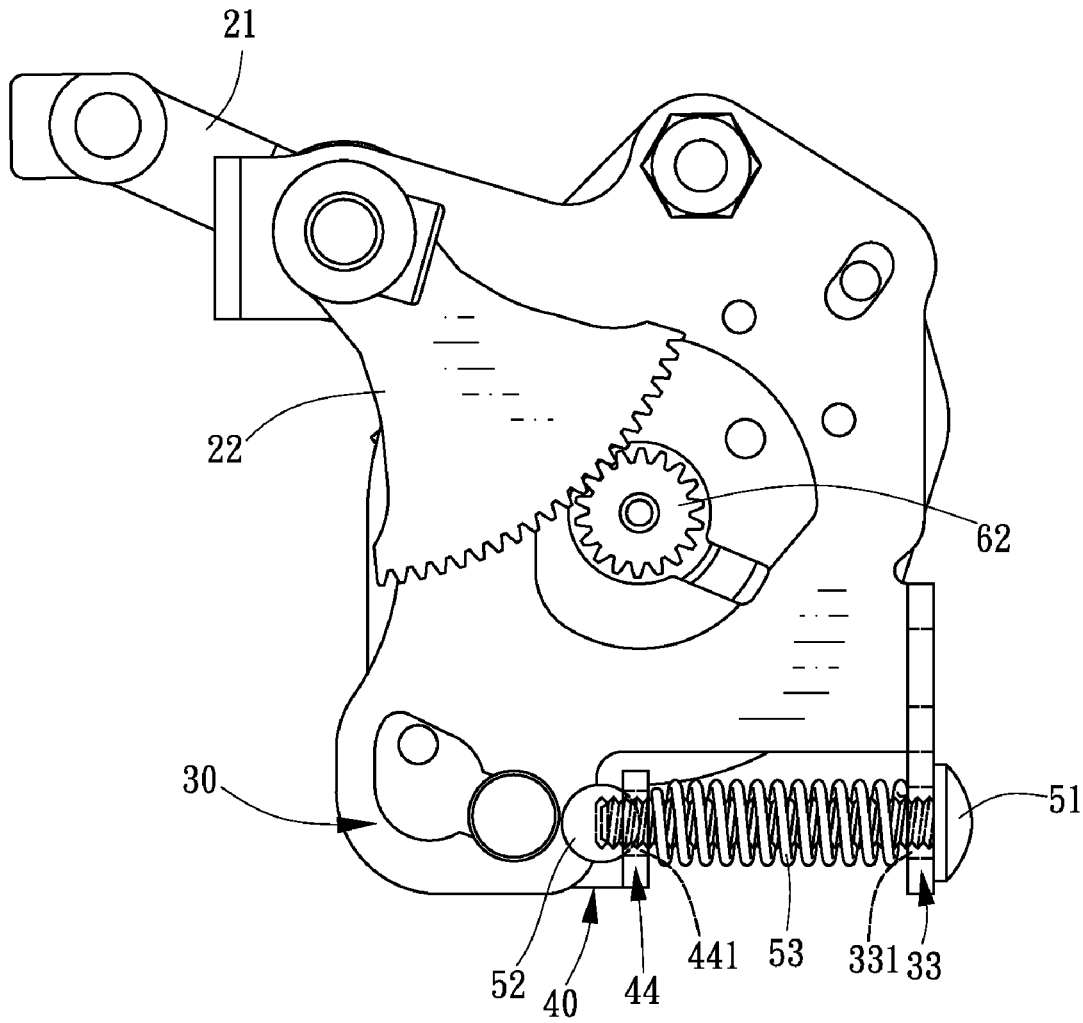
FIG. 3 is a planar end view of the travel beginning/end adjusting positioning structure for a sewing machine motor drive mechanism (not adjusted) in accordance the present invention.

Referring to FIGS. 1-3 showing a travel beginning/end adjusting positioning structure for a sewing machine motor drive mechanism in accordance with a preferred embodiment of the present invention, the sewing machine 10 is provided with a control shaft 20 on a base 11 thereof. A first end of the control shaft 20 is provided with a swing arm 21 which is drivingly connected to a cloth delivering gear, and on a second end of the control shaft 20 is provided a control element 22 in the form of a sector gear. The travel beginning/end adjusting positioning structure for a sewing machine motor drive mechanism in accordance with the present invention comprises a fixed holder 30, a positioning holder 40 and an adjusting apparatus 50.

The fixed holder 30 is plate-shaped and includes a central through hole 31, and a pivoting hole 32 in a top end thereof. The fixed holder 30 is further provided with a fixing portion 33 vertically bent from a bottom end thereof. The fixing portion 33 includes an elongated insertion hole 331. The fixed holder 30 is fixed on the base 11 of the sewing machine 10.

The positioning holder 40 is plate-shaped and provided with a through hole 41 in alignment with the through hole 31 of the fixed holder 30, and a pivot hole 42 in alignment with the pivoting hole 32 of the fixed holder 30. The positioning holder 40 and the fixed holder 30 are pivotally connected by inserting a pivot element 43 through the pivoting hole 32 of the fixed holder 30 and the pivot hole 42 of the positioning holder 40. The positioning holder 40 is further provided with a positioning portion 44 which is vertically bent from a bottom end thereof opposite the fixing portion 33 of the fixed holder 30. The positioning portion 44 is formed with a through hole 441. The fixed holder 30 has a side for mounting a motor 60, and a rotating shaft 61 of the motor 60 is inserted through the through hole 41 of the fixed holder 30 and the through hole 31 of the fixed holder 30. A rotating element 62 is mounted on the rotating shaft 61 of the motor 60. Furthermore, the pivot element 43 in the present embodiment is provided with a pivot sleeve 430 extending toward the pivoting hole 32 and the pivot hole 42. The pivot sleeve 430 is centrally hollow in such a manner that the control shaft 20 can be rotatably inserted through the pivot sleeve 430, and the positioning holder 40 is rotatably mounted on the pivot sleeve 430 without direct contacting the control shaft 20, avoiding the improper friction due to contact between the control shaft 20 and the positioning holder 40.

Figure 4:
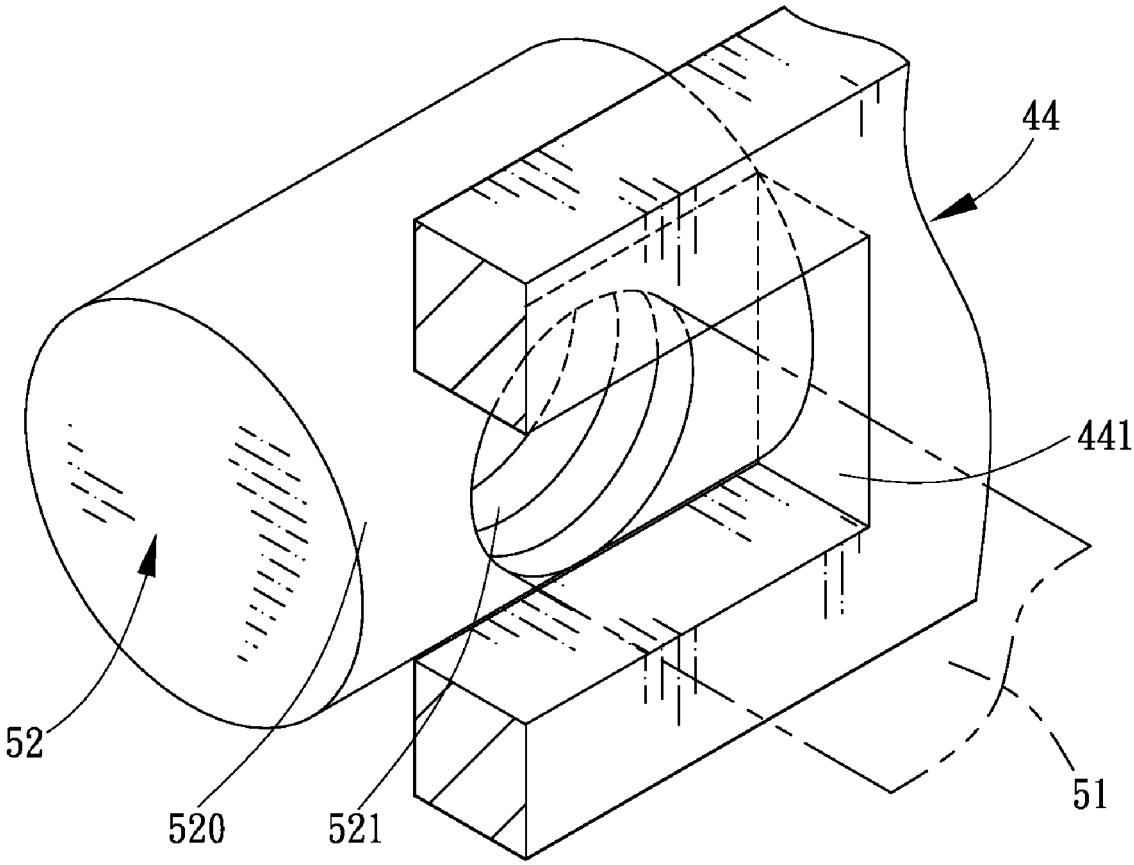
FIG. 4 is a perspective view showing that the locking element of the adjusting apparatus is partially engaged in the through hole of the positioning portion in accordance with the present invention.

The adjusting apparatus 50 includes an adjusting element 51 and a locking element 52 screwed to the adjusting element 51. The adjusting element 51 is a screw and has a disc-shaped head portion 510 and a threaded adjusting shaft 511 which extends from a center of the head portion 510 and is smaller in outer diameter than the head portion 510. The locking element 52 is in the form of a column and formed with an arc peripheral surface 520 opposite the through hole 441. In the arc peripheral surface 520 is formed a threaded hole 521 in alignment with the adjusting shaft 511. The adjusting apparatus 50 is assembled in such a manner that the adjusting shaft 511 of the adjusting element 51 is inserted through the insertion hole 331 of the fixing portion 33 of the fixed holder 30 and the through hole 441 of the positioning portion 44 of the positioning folder 40 and screwed into the threaded hole 521 of the locking element 52, and the head portion 510 abuts against the fixing portion 33 outside the insertion hole 331. The arc peripheral surface 520 of the locking element 52 is engaged in the through hole 441 of the positioning portion 44 of the positioning holder 40, as shown in FIG. 4, so that the adjusting element 51 of the adjusting apparatus 50 can be rotated to make the locking element 52 move close to or away from the head portion 510 of the adjusting element 51, adjusting the relative position of the positioning holder 40 and the fixed holder 30.

In the present embodiment, the adjusting apparatus 50 is further provided with an elastic element 53 mounted on the adjusting element 51, and both ends of the elastic element 53 push against the fixing portion 33 of the fixed holder 30 and the positioning portion 44 of the positioning holder 40 for providing an elastic prestress to the positioning holder 40, the fixed holder 30 and to the whole adjusting apparatus 50, thus making sure that the adjusting apparatus 50 is kept in the positioned state after adjustment.

The aforementioned is the summary of the positional and structural relationship of the respective components of the preferred embodiment in accordance with the present invention.

Figure 5:
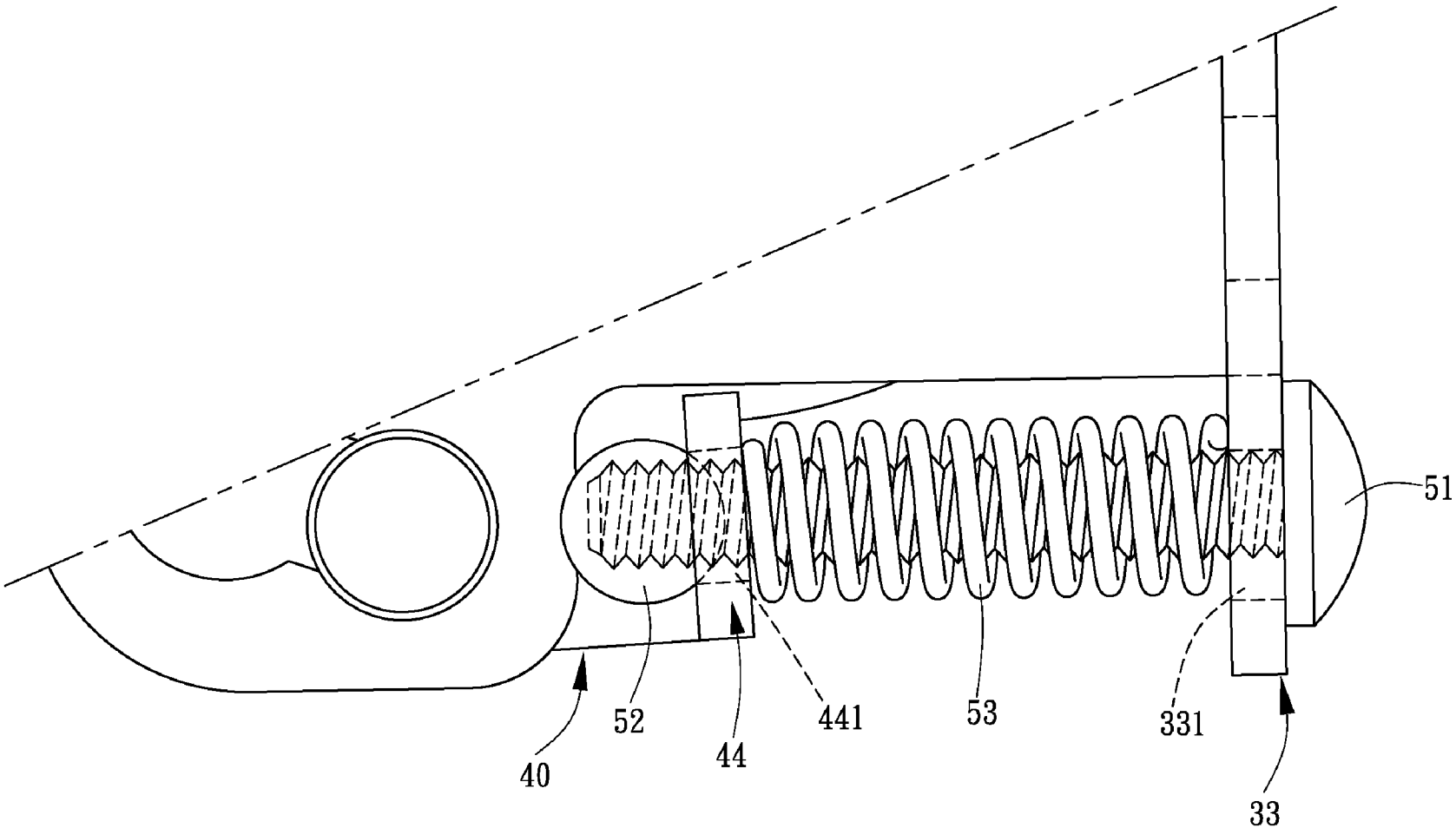
FIG. 5 is a side view of the adjusting apparatus which has performed the adjustment in accordance with the present invention.
Figure 6:
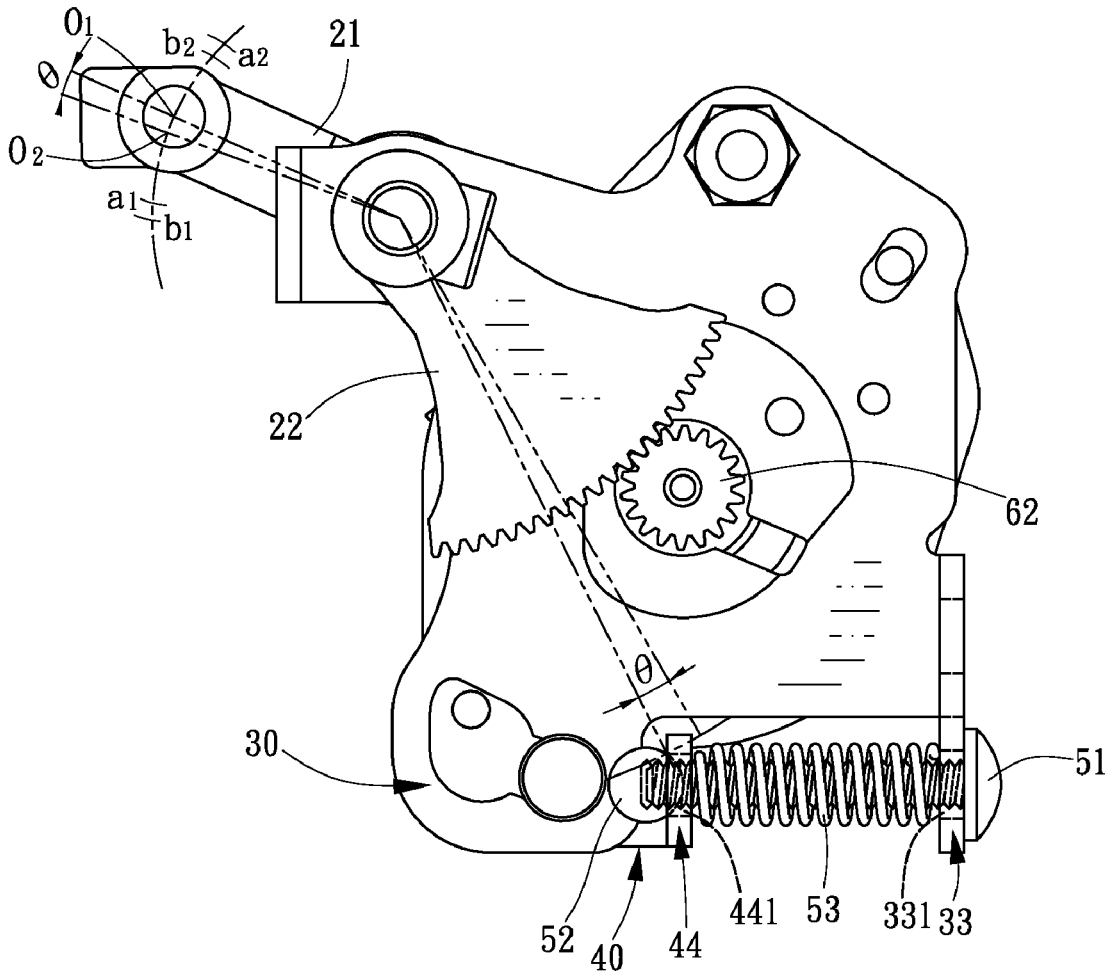
FIG. 6 is an operational view showing how the adjusting apparatus performs the adjustment in accordance with the present invention.

For a better understanding of the present invention, its operation and function, reference should be made to the following description:

When in use, as long as the adjusting element of the adjusting apparatus 50 is adjusted by rotation, the locking element 52 screwed on the adjusting element 51 will rotate along the thread on the adjusting element 51 to push the positioning portion 44 of the positioning holder 40 to move, further changing the distance between the fixing portion 33 of the fixed holder 30 and the positioning portion 44 of the positioning holder 40. As shown in FIG. 5, the positioning holder 40 is made to pivot around the pivot sleeve 430 of the pivot element 43. Referring to FIG. 6, since the positioning portion 44 pivots around the pivot sleeve 430 by an adjusting angle θ, the motor 60 on the positioning holder 40 will also rotate the angle θ. Since the rotating element 62 of the motor 60 is engaged with the control element 22, the control shaft 20 on the control element 22 will also rotate the adjusting angle θ, and so will the swing arm 21 on the first end of the control shaft 20, moving the distal end of the swing arm 21 which was originally at a middle point O1 of the travel to a secondary middle point O2, so that the beginning point a1 and the end point a2 of the travel a1*a*2 which were originally formed around the middle point O1 will be changed to the travel beginning point b1 and the travel end point b2 of the travel b1*b*2, immediately making the beginning and end points of the travel of the swing arm rotate. By such arrangements, it can effectively and immediately adjust the travel of a structure connected to the distal end of the swing arm 21 to satisfy the requirements of the actual operation, adjusting the error in the production conveniently and quickly.

Through cooperation of the through hole 441 of the positioning portion 44 of the positioning holder 40 and the locking element 52, the locking element 52 is prevented from rotating around an axis of the adjusting shaft 511 of the adjusting element 51. Through cooperation of the peripheral surface of the locking element 52 and the through hole 441, the locking element 52 can rotate around the peripheral surface thereof, so that while the adjusting element 51 is adjusted by rotation, the locking element 52 can rotate along with the adjusting shaft 511 of the adjusting element 51.

The through hole 441 is formed into a square through hole, and the locking element 52 is in the form of a column, so that when the adjusting shaft 511 of the adjusting element 51 is inserted through the through hole 441 and screwed into the threaded hole 521 of the locking element 52, the arc peripheral surface 520 of the locking element 52 will be partially engaged in the through hole 441 of the positioning portion 44 of the positioning holder 40, preventing the locking element 52 from rotating around the axis of the adjusting shaft 511. Hence, it can avoid the loosening of the locking element 52 when the motor 60 vibrates, further enhancing the stability of the present invention.

In addition, when the locking element 52 presses against the positioning portion 44 of the positioning holder 40, since the locking element 52 is in the form of a column, besides that the peripheral surface 520 of the locking element 52 is partially engaged in the through hole 441 of the positioning portion 44 of the positioning holder 40, the locking element 52 will contact the positioning portion 44 with both upper and lower sides thereof being pressed against by the positioning portion 44. Moreover, when the adjusting element 51 is adjusted to make the positioning portion 44 of the positioning holder 40 move, the positioning portion 44 will lean slightly due to pivoting. Since the locking element 52 is in the form of a column, it will rotate to cooperate with the positioning portion 44 in the extending direction of the arc peripheral surface 520 no matter how many degrees the positioning portion 44 leans. In terms of the present embodiment, the locking element 52 in the form of a column rotates around the axis of the column to keep the arc peripheral surface 520 pressing against the upper and the lower sides of the positioning portion 44 without leading to adjustment error.

Figure 7:
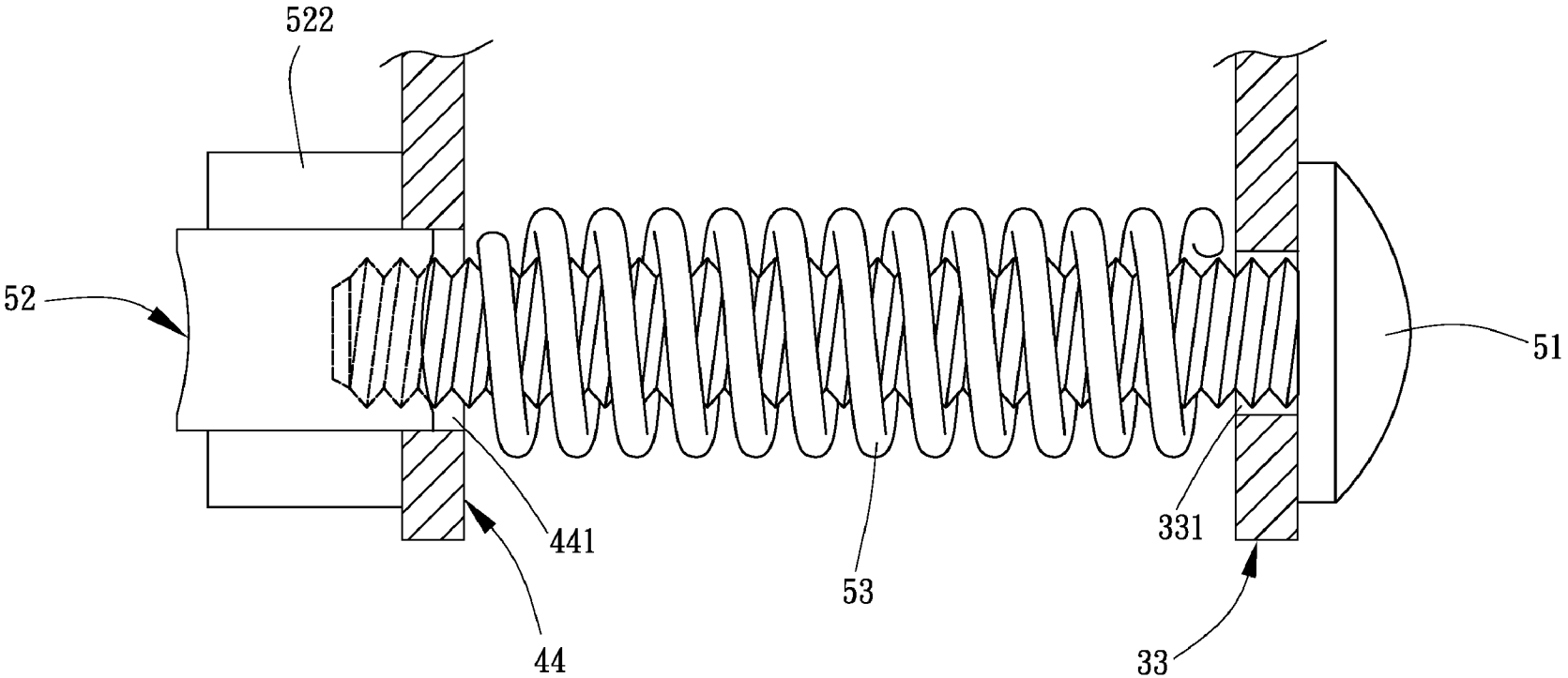
FIG. 7 is a top view showing that the locking element is provided with a limiting cylinder on each of two opposite ends thereof.
Figure 8:
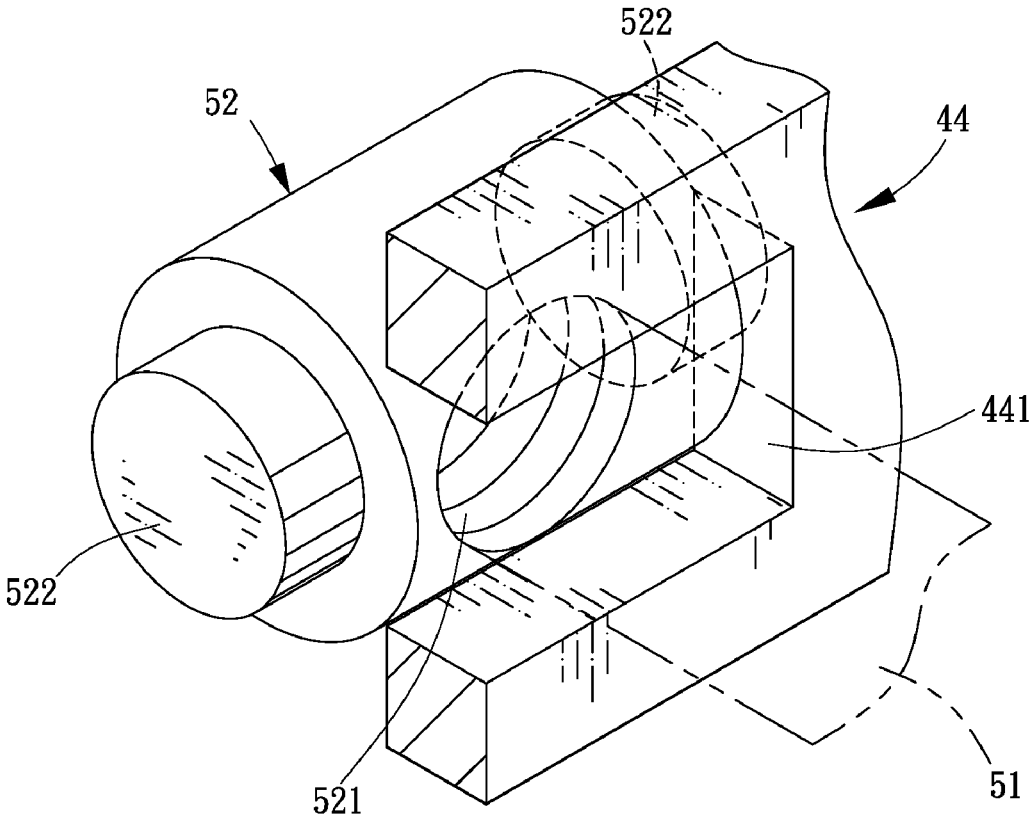
FIG. 8 is a perspective view showing that the locking element is provided with the limiting cylinder on each of two opposite ends thereof.

Referring to FIGS. 7 and 8, the locking element 52 in the above embodiment can also be coaxially provided on each of two end surfaces thereof with a limiting cylinder 522 which is smaller in diameter than the locking element 52, so that when the arc peripheral surface 520 of the locking element 52 is partially engaged in the through hole 441 of the positioning portion 44 of the positioning holder 40, the two limiting cylinders 522 can push against side surfaces of the positioning portion 44 for assisting limiting the locking element 52 to the positioning portion 44, enhancing the firmness of the locking element 52.

Figure 9:
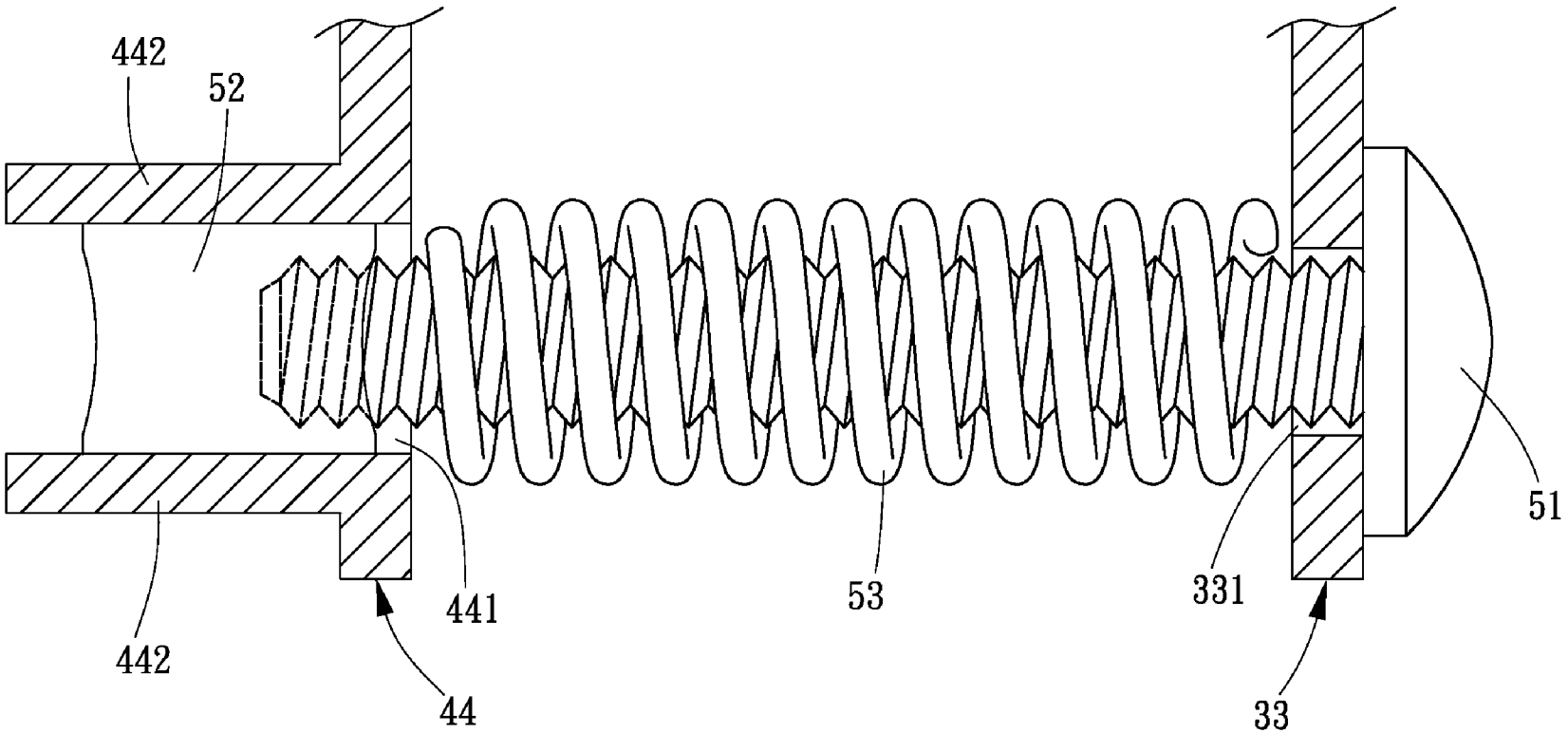
FIG. 9 is a planar view showing that the locking element is partially engaged in the positioning portion of the positioning holder and limited by the limiting portions of the positioning portion.
Figure 10:
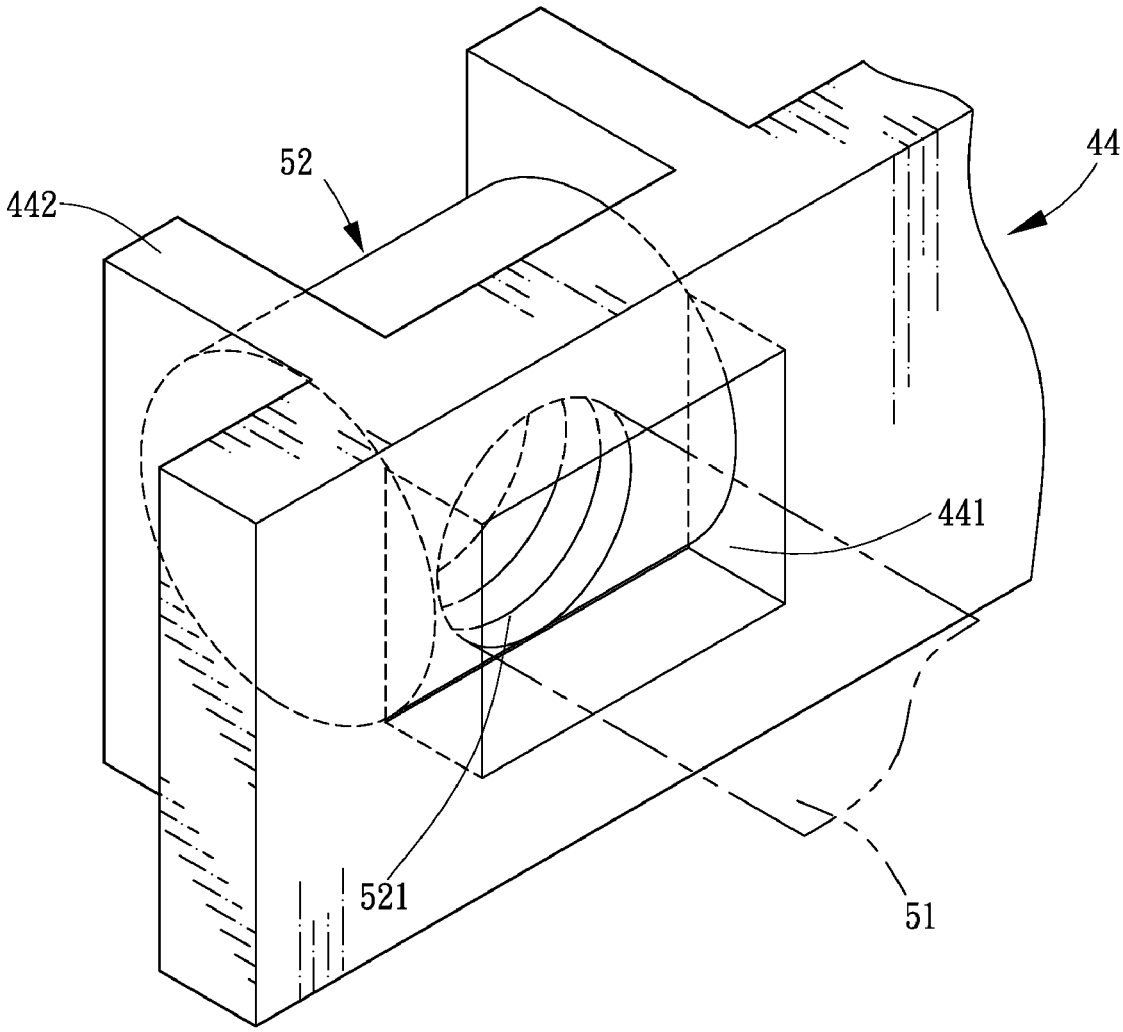
FIG. 10 is a perspective view showing that the locking element is partially engaged in the positioning portion of the positioning holder and limited by the limiting portions of the positioning portion.

Referring to FIGS. 9 and 10, the positioning portion 44 of the positioning holder 40 in the above embodiment can also be provided with a limiting portion 442 protruding at each of two opposite sides of the through hole 441 in such a manner that the locking element 52 can be arranged between the two limiting portions 442 for enhancing the stability of the locking element 52.

Figure 11:
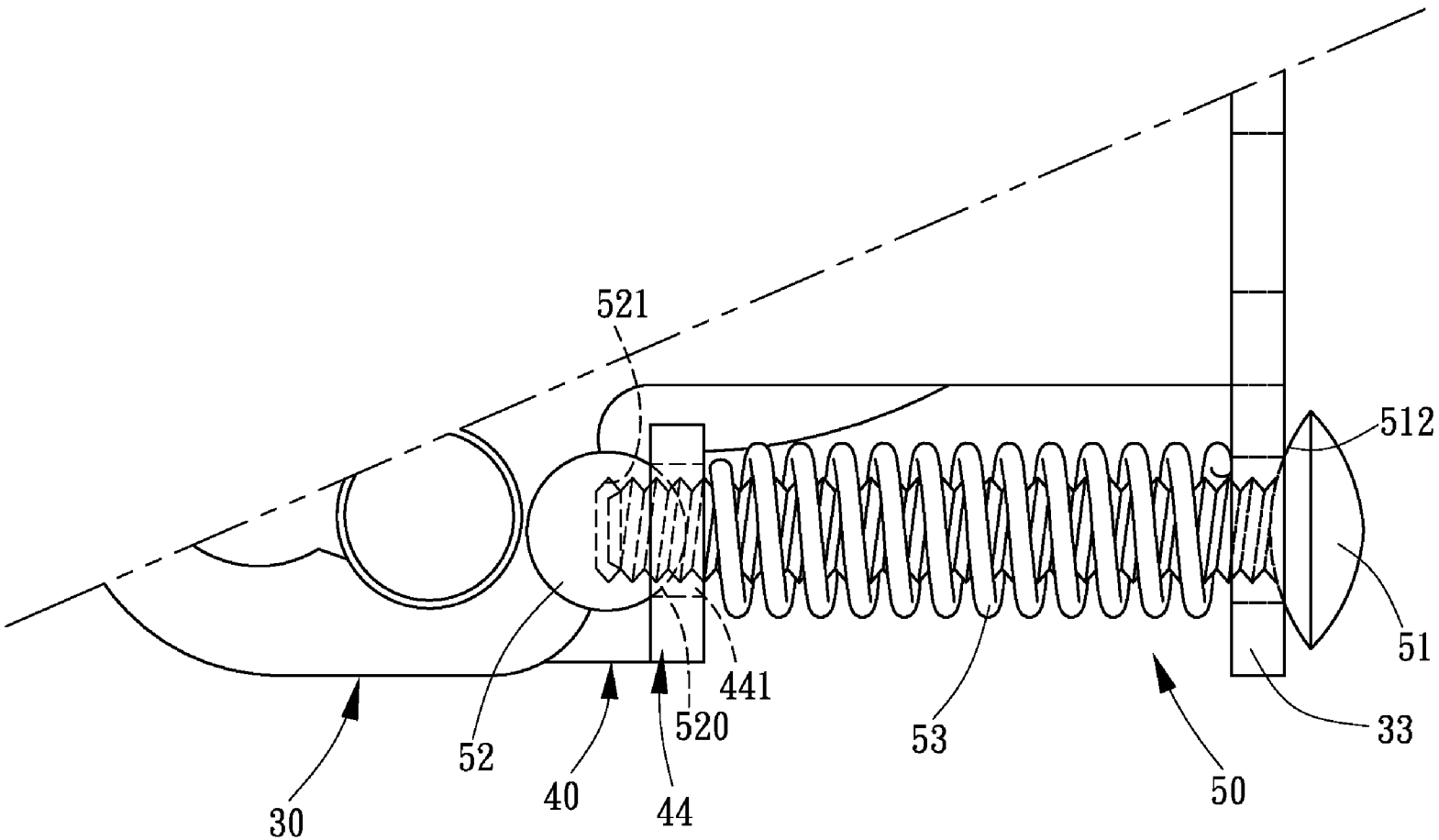
FIG. 11 is a planar view showing that the head portion of the adjusting element includes a stopping surface.

Referring to FIG. 11, the head portion 510 of the adjusting element 51 can also be formed with an arc convex stopping surface 512 on an end thereof which contacts the fixing portion 33. By partially engaging the stopping surface 512 in the insertion hole 331, the head portion 510 of the adjusting element 51 can be automatically aligned with the center of the insertion hole 331. Further, under the action of the elastic prestress provided by the elastic element 53, the adjusting element 51 can be assuredly maintained in alignment with the center of the insertion hole 331, keeping the whole adjusting apparatus 50 in the optimal cooperation state.

While we have shown and described various embodiments in accordance with the present invention, it is clear to those skilled in the art that further embodiments may be made without departing from the scope of the present invention.

What is claimed is:

1. A travel beginning/end adjusting positioning structure for a sewing machine motor drive mechanism, the sewing machine including a control shaft, on the control shaft being provided a control element, the travel beginning/end adjusting positioning structure comprising:

a fixed holder being provided with a fixing portion on an end thereof and fixed on the sewing machine;

a positioning holder having an end pivoted on a pivoting element together with the fixed holder, the control shaft being rotatably inserted through the pivot element, the positioning holder being further provided with a positioning portion opposite the fixing portion of the fixed holder, the positioning portion being formed with a through hole, the fixed holder having a side for mounting a motor, on a rotating shaft of the motor being mounted a rotating element, the rotating element being engaged with the control element of the control shaft; and an adjusting apparatus including an adjusting element, a locking element screwed to the adjusting element, and an elastic element, the adjusting element having a head portion and a threaded adjusting shaft extending from the head portion, the locking element being formed with an arc peripheral surface and a threaded hole in the arc peripheral surface, the adjusting shaft of the adjusting element being inserted through the fixing portion of the fixed holder and the through hole of the positioning portion of the positioning folder, the adjusting shaft being screwed into the threaded hole locking element, the arc peripheral surface of the locking element cooperating with the through hole of the positioning portion of the positioning holder, the locking element rotating in an extending direction of the arc peripheral surface, the elastic element being mounted on the adjusting shaft of the adjusting element with both ends of the elastic element pushing against the fixing portion of the fixed holder and the positioning portion of the positioning holder.

2. The travel beginning/end adjusting positioning structure for a sewing machine motor drive mechanism as claimed in claim 1, wherein the pivot element includes a pivot sleeve, the positioning holder is formed with a pivot hole.

3. The travel beginning/end adjusting positioning structure for a sewing machine motor drive mechanism as claimed in claim 1, wherein the locking element is coaxially provided on each of two end surfaces thereof with a limiting cylinder which is smaller in diameter than the locking element, the arc peripheral surface of the locking element cooperates with the through hole of the positioning portion of the positioning holder, the two limiting cylinders push against the positioning portion.

4. The travel beginning/end adjusting positioning structure for a sewing machine motor drive mechanism as claimed in claim 1, wherein the positioning portion of the positioning holder is provided with a limiting portion protruding at each of two opposite sides of the through hole, the locking element is arranged between the two limiting portions.

5. The travel beginning/end adjusting positioning structure for a sewing machine motor drive mechanism as claimed in claim 1, wherein the head portion of the adjusting element is formed with an arc convex stopping surface on an end thereof which contacts the fixing portion, the fixing portion includes an insertion hole, and the stopping surface cooperates with the insertion hole.

6. The travel beginning/end adjusting positioning structure for a sewing machine motor drive mechanism as claimed in claim 1, wherein the positioning holder is provided with a through hole, the fixed holder includes a through hole, the rotating shaft of the motor is inserted through the through hole of the positioning holder and the through hole of the fixed holder.

7. The travel beginning/end adjusting positioning structure for a sewing machine motor drive mechanism as claimed in claim 1, wherein the locking element is in the form of a column, the through hole of the positioning portion of the positioning holder is a square through hole, the locking element cooperates with the square through hole to keep non-rotating relative to each other.

8. The travel beginning/end adjusting positioning structure for a sewing machine motor drive mechanism as claimed in claim 1, wherein the head portion of adjusting element is disc-shaped.

* * * * *